US005459282A

United States Patent [19]

Willis

[11] Patent Number: 5,459,282

[45] Date of Patent: Oct. 17, 1995

[54] SYSTEM FOR REJUVENATING VINTAGE ORGANS AND PIANOS

[76] Inventor: Raymon A. Willis, 419 E. Thirty-third St., Savannah, Ga. 31401

[21] Appl. No.: 241,860

[22] Filed: May 12, 1994

Related U.S. Application Data

[63] Continuation-in-part of Ser. No. 950,518, Sep. 25, 1992.

[51] Int. Cl.[6] ..... G10H 7/00

[52] U.S. Cl. ..... 84/645; 84/171

[58] Field of Search ..... 84/170, 171, 174, 84/219–221, 331, 645

[56] References Cited

U.S. PATENT DOCUMENTS 4,686,880 8/1987 Salani et al. .
4,704,931 11/1987 Nagai et al. ..... 84/2 X
4,766,796 8/1988 Langowski ..... 84/220
4,768,412 9/1988 Sanderson .
5,001,339 3/1991 Starkey et al. .
5,237,125 8/1993 Fields ..... 84/645 X

*Primary Examiner*—William M. Shoop, Jr.
*Assistant Examiner*—Jeffrey W. Donels
*Attorney, Agent, or Firm*—Jim Zegeer

[57] ABSTRACT

A system for expeditiously rejuvenating conventional old keyboard musical instruments to MIDI standards at low cost is disclosed. One or more linear arrays of key actuation sensors and a printed circuit board carry the key actuation sensors for sensing key actuation and expression effects by a musician are mounted above the keyboard of the musical instrument by a rigid mounting bar to convert each key actuation and expression effect of the musician to first coded electrical signals, respectively. Each key actuation sensor incudes a device for individually vertically adjusting the sensor relative to the mounting bar.

19 Claims, 11 Drawing Sheets

PROGRAMMABLE PARAMETERS:

| NAME | EXPLANATION |
|---|---|
| CARD FORMAT | THE CARD FORMAT ALLOWS THE USER TO SAVE ANY OF THE 200 SOUNDS, INTERNAL OR EXTERNAL, AND LOAD THEM ON A CIRCUIT CARD TO HAVE ONLY THE SOUNDS HE OR SHE SELECTS FROM 1-200. SO THE USER CAN CARRY HIS OR HER FAVORITE CARDS TO ENTERTAIN WHERE EVER THE SYSTEM IS AVAILABLE. THIS WILL ELIMINATE THE TRANSPORT OF KEYBOARD, AMPS, ETC. |
| NOTE ASSIGN | THE NOTE ASSIGN-ALLOWS THE USER TO ASSIGN ANY SOUND TO A SELECT KEY, FOR EXAMPLE WITH THE SYSTEM DRUM PADS THE USER CAN SELECT ANY OF THE 200 SOUNDS INTERNAL OR EXTERNAL, AND ASSIGN TO ANY OF THE REAR PANEL JACKS 1-1b. |
| FADE ON/OFF V. 1-10 | THIS ALLOWS THE USER TO SELECT THE SOUNDS INTERNAL/EXTERNAL TO FADE IN OR OUT WHILE PLAYING DURING A LIVE PERFORMANCE. |
| LINK 1-10 | WITH THE LINK FUNCTION THIS ALLOWS THE USER TO LINK UP TO TEN TONE PITCHES INTERNAL/EXTERNAL FROM THE 200 SOUNDS AVAILABLE BY PRESSING THE LINK SWITCH.THIS FUNCTION SAVES VALUABLE TIME DURING A LIVE PERFORMANCE. |

EXTERNAL JACKS:

| | |
|---|---|
| PROGRAM/SEQUENCER CARD SLOT: | THESE ARE TWO SEPARATE CARD SLOTS, ONE FOR THE SEQUENCER TO SAVE/LOAD SONGS OR SEQUENCE TRACKS: SAME APPLY FOR THE PROGRAM CARD SLOT, THE USER WOULD BE ABLE TO SAVE/LOAD SOUNDS FROM THE INTERNAL/EXTERNAL SOUNDS TO A CARD, HAVING UP TO (200) OF HIS/HER FAVORITE SOUNDS: THIS WOULD ENABLE THE USER TO HAVE HIS/HER UNLIMITED SYSTEM SOUND LIBRARY. |

VOLUME/ASSIGNABLE PEDAL:

WITH THIS OUTPUT JACK THIS ALLOWS THE USER TO ASSIGN A FOOT PEDAL TO CONTROL VOLUME/PROGRAM UP/SUSTAIN.

SEQUENCER-START/STOP:

WITH THIS FUNCTION THE USER CAN CONTROL THE PLAY/STOP FROM A FOOT SWITCH: WITH THE REMOTE CONTROL THE USER CAN CONTROL FUNCTION SUCH AS PLAY-STOP/ TRACK SELECT/ BAR SELECT/SONG SELECT/ TEMPO/VOLUME, ETC.: IT'S IDEAL FOR REHEARSAL, HOME LISTENING, OR JUST HOW YOUR PLAYING WOULD SOUND TO AN AUDIENCE:

KEYBOARD/PERCUSSION SWITCH:

WITH THE KEYBOARD/PERCUSSION SWITCH: SINCE THE SYSTEM CAN BE USED WITH OTHER MIDI DEVICES, SUCH AS KEYBOARDS, DRUM MACHINES, ETC. THIS SWITCH DISABLES FUNCTIONS, SUCH AS THE SILENCER, AND ALL OTHER FUNCTIONS USED WITH THE APPLICATION FOR THE PIANO/ORGAN

FIG. 6

SYSTEM FOR REJUVENATING VINTAGE ORGANS AND PIANOS

REFERENCE TO RELATED APPLICATION

This application is a continuation-in-part of my application Ser. No. 07/950,518 filed Sep. 25, 1992 for "SYSTEM FOR REJUVENATING VINTAGE ORGANS AND PIANOS".

BACKGROUND AND BRIEF DESCRIPTION OF THE INVENTION

Numerous old pianos and organs are located in schools, churches, and entertainment complexes (community recreation centers, night clubs, etc.). To replace them with modern electronic musical equipment which has been provided with the flexibility of an musical instrument digital interface (MIDI) would be very expensive. Many churches, communities and school systems cannot afford expensive new electronic musical equipment and their current older equipments, while adequate for limited musical services, are not able to support visiting musical groups, for example, who must therefore bring their own musical instrumental accompaniments to maintain the "sound" achieved by that group in their home area. For example, a choral group given to accompaniment by a particular organ "sound" does not sound the same when accompanied by an older organ or piano.

The object of this invention is to provide a method and apparatus for easily and more quickly upgrading old organs and pianos at relatively low cost and provide such older organs and pianos with sensors for sensing key and pedal actuation and means to mute or prevent sound from being generated by the instrument. The sensed key and pedal activation is converted to electrical signals, digitized and formatted by conventional electronic circuitry. These signals are applied to a MIDI controller which, in turn, can control various electronic musical modules (piano, organ, guitar, violin, etc.) for a visiting choral group, for example.

According to the present invention, linear arrays of novel key actuation and expression effect break-gap-make sensor switches on a printed circuit board over key mounting bar (which has sufficient rigidity to prevent deflection thereof) positioned over, and aligned with, the keys of a vintage electronic organ or acoustic piano being rejuvenated to thereby individually sense key actuation and expression effects. By mounting the key sensor strips over or above the keys of a piano or organ, the rejuvenation process can be easily and quickly accomplished in a very economical manner. Keys on old pianos and organs often times have keys which are not level. The over key mounting bar includes adjustment means for vertical and horizontal adjustments of the bar relative to the keys. Each break-gap-make switch is individually adjustable in a vertical direction to take account of non-levelness of any note key due to wear and aging, particularly in older acoustic pianos and organs. Separate sensors are coupled to the pedals ("soft", "sustain", "sustenuto") of a piano, for example.

In the case of an acoustic piano, a muting pad and bar is positioned between the ranks of note hammers and piano strings and mutes the piano. In the case of an pipe organ, the air pump or supply is shut off, and in the case of an electronic organ, the power amplifier can be turned off by a disable signal. The muting bar can also serve as a carrier for magnetic sensors which become aligned with each string of a piano in the non-muting mode. The magnetic sensors are coupled to an amplifier/speaker system.

In a preferred embodiment, the break-gap-make switch housings are threadably mounted in the mounting bar providing a vertical vernier adjustment for each individual key.

A further object of this invention is to eliminate having three or four keyboards when the musician can incorporate his or her module, drum machine or sampler, etc. and MIDI it into a vintage organ or vintage piano.

A further advantage of the invention, is that you can have that rich "Hammond" organ sound; in addition the musician would have access to thousands of sounds such as piano, strings, bass, brass, percussion sounds, etc. The musician can also use the present invention to write songs, record and playback all from one organ or piano, and can also prepare musical sound tracks, so when he or she go to the studio all they would have to do is the vocals; this will cut studio time by at least 50%.

DESCRIPTION OF THE DRAWINGS

The above and other objects, advantages and features of the invention will become more apparent when considered with the following specification and accompanying drawings wherein:

FIG. 6 is a table of features that can be incorporated in the invention's MIDI adapter kit.

DETAILED DESCRIPTION OF THE INVENTION

Figure 1A:
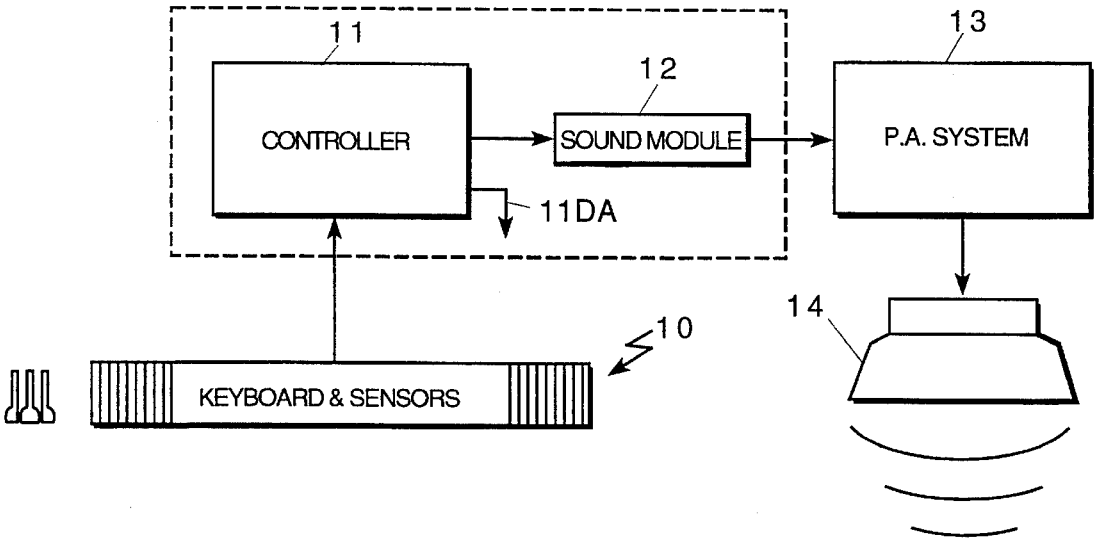
FIG. 1A is a general block diagram of the electronic system incorporated in this invention.

Referring to FIG. 1A, a keyboard 10, which is on an older vintage piano or organ has been fitted with over key sensor strips, as described later herein, so that operation of the keys on the keyboard by the musician is scanned or strobed to detect keyboard actuations and produce electrical signals corresponding to the key actuation, force or intensity and duration. These signals are supplied to a conventional MIDI controller or interface 11. The functions of interface 11 and modules 12 may be incorporated in a common unit as indicated by the dotted rectangle. MIDI interface 11 includes conventional microprocessor circuitry which enables controller 11 to command sound module 12, which may also include a microprocessor for receiving and interpreting control signals from the microprocessor in MIDI controller 11. MIDI is the digital operating standard for electronic music and many texts and articles provide extensive details thereof. FIG. 6 is a table of optional features that may be incorporated in the system of this invention. Reference is made to the text "Synthesizers And Computers" edited by Brent Hurtig, copyright 1985, 1987, which is incorporated herein by reference. There may be many different forms or styles of modules 11, each of which produces a different "sound" on control from controller 11 which, in turn, receives data input from the sensor strips which have been installed under keyboard 10 of the older musical instrument.

Module 12 can include card slots for additional sounds. For example, sound module 12 can carry a card having the sound of a 16 bit stereo piano which provides the rich time stereo sound of a concert grand piano such as Proformance™ Model 9101 or Proformance™ Model 9102 from E-Mu Systems, Inc. In these modules, exceptionally realistic sounds of a real grand piano are permanently recorded in digital memory chips and processed in very large scale integrated circuits (VLSI) technology. The output has a wide dynamic range and frequency response which results in the rich sound of a very expensive concert grand.

If the instrument has foot operated pedals 10P, they will also be equipped with sensor strips according to the invention.

Module 12 provides analog output signals of the various notes selected to be played by keyboard 10 to power amplifier system 13 and thence to loud speakers 14. The MIDI controller 11, module system 12, power amplifier 13 and loud speakers 14 are conventional and hence need not be described in greater detail herein. When activated, controller 11 optionally, may provide a disable signal 11DA which is used to disable the regular electronic organ components and thus mute same, or activate a bar between the hammers of a piano and the string struck thereby.

Figure 5:
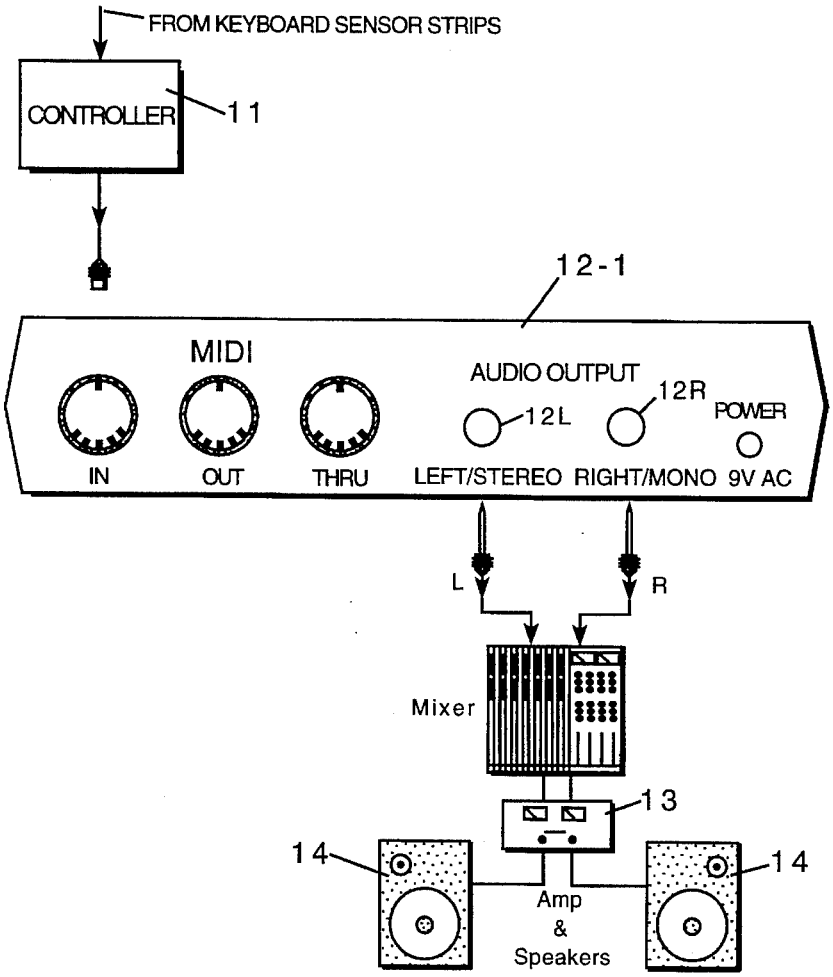
FIG. 5 (PRIOR ART)
FIG. 5 is a diagrammatic illustration of a portion of the rear panel of one commercial sound module used in the invention.

FIG. 5 (prior art) is a diagrammatic illustration of a portion of the rear panel of The Proformance™ sound module 10-1 with MIDI "in", "out" and "through" connectors, the output of MIDI controller 11 being connected to the "in" connector, and the audio output jacks 12L and 12R being coupled to a mixer 9 and then a amplifier 13 to speakers 14.

Figure 1B:
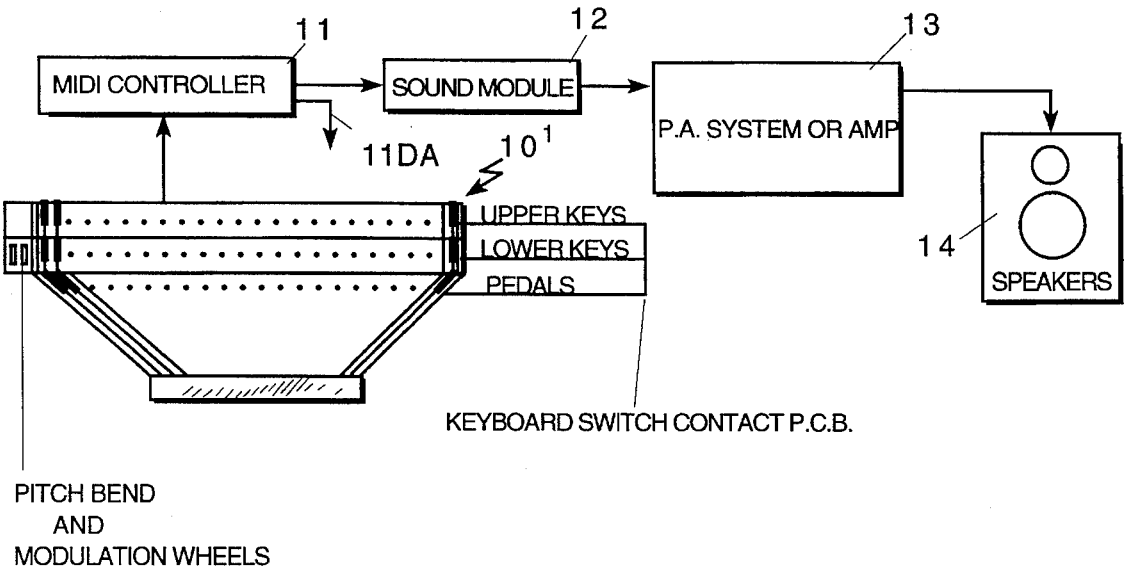
FIG. 1B is a block diagram of the invention as applied to a an organ.
Figure 1C:
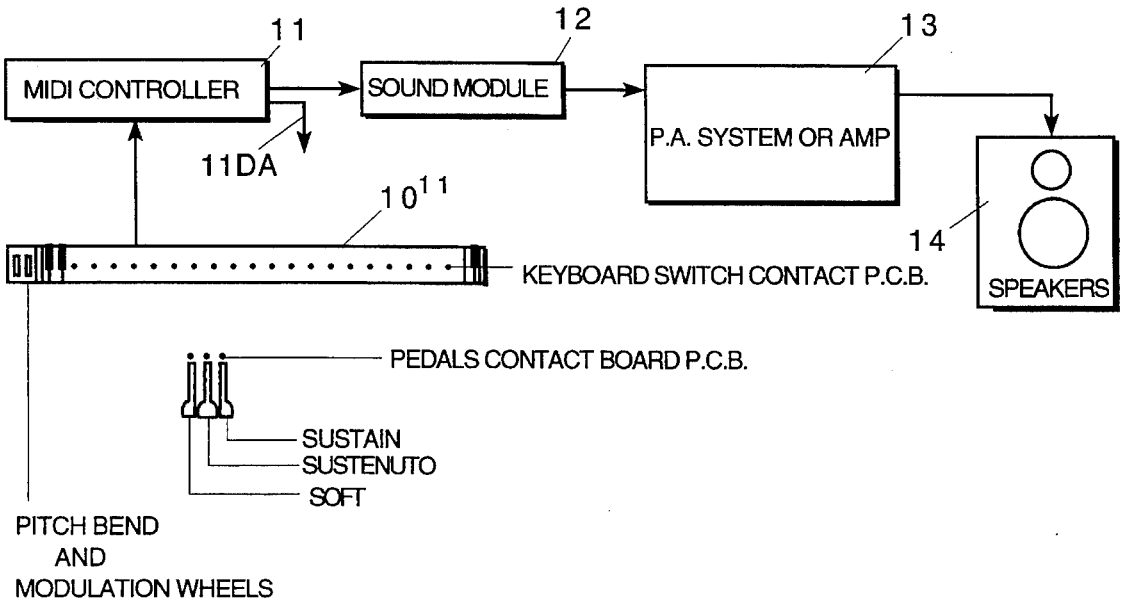
FIG. 1C is a block diagram of the piano MIDI adaptor kit of this invention.

FIG. 1C is a block diagram of the invention as applied to a piano and, in this case, the keyboard 10" is provided with key contact circuit boards and FIG. 1B is the system applied to an organ.

Referring to FIGS. 2A, 2B, 2C, 2D, 2E and 2F the key contact board which is mounted over the keyboards of a piano and includes a rigid carrier bar CB carrying a printed circuit board 21. Electrical connectors or male plugs MP for receiving female plugs FP associated with each break-gap-make switch. Conventional diode circuits DC on printed circuit board 21 produce electrical signals at the output terminals 25, 26 which are scanned or strobed by the MIDI interface control circuit 11 to detect the actuation of the key, the intensity with which the key is contacted, and the length of time that it is held down by the musician.

As shown in the sectional view, the printed circuit board 21 is provided with a sensor carrier and rigidifying member which, in the preferred embodiment, is a bar or channel member 30 upon which the printed circuit board 21 is formed or insulatingly mounted.

Figure 2A:
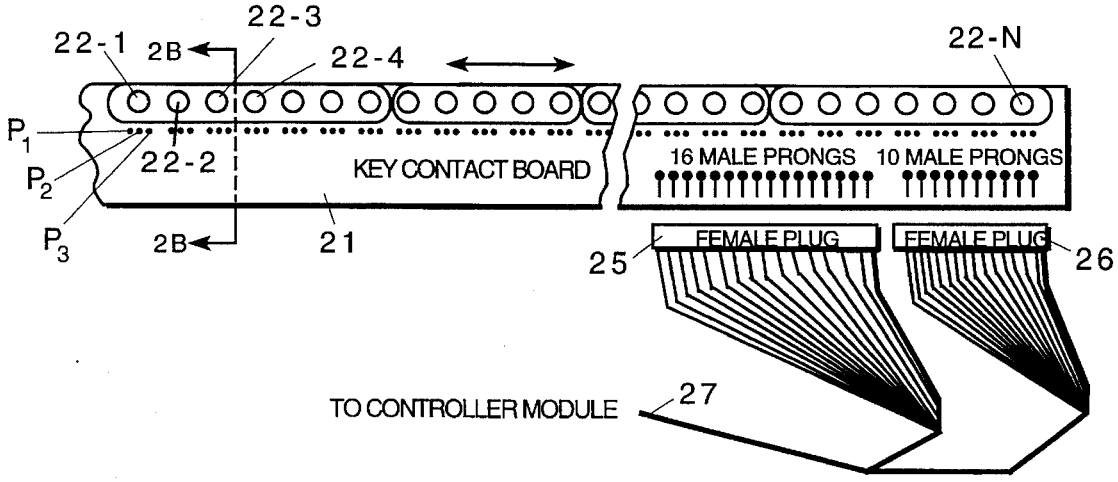
FIG. 2A is a top plan view of one embodiment of the over key actuation sensor strip device of the present invention.
Figure 2B:
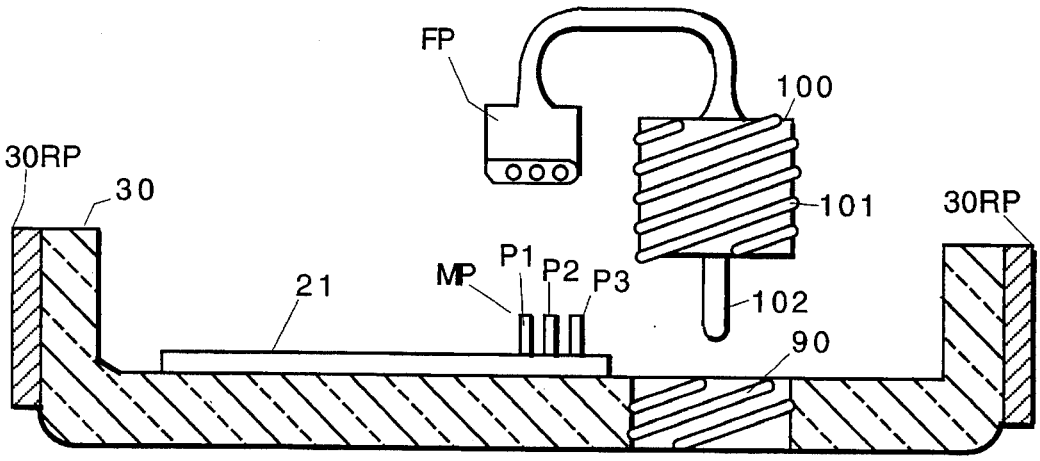
FIG. 2B is a sectional view on lines A—A of FIG. 2A.
Figure 2C:
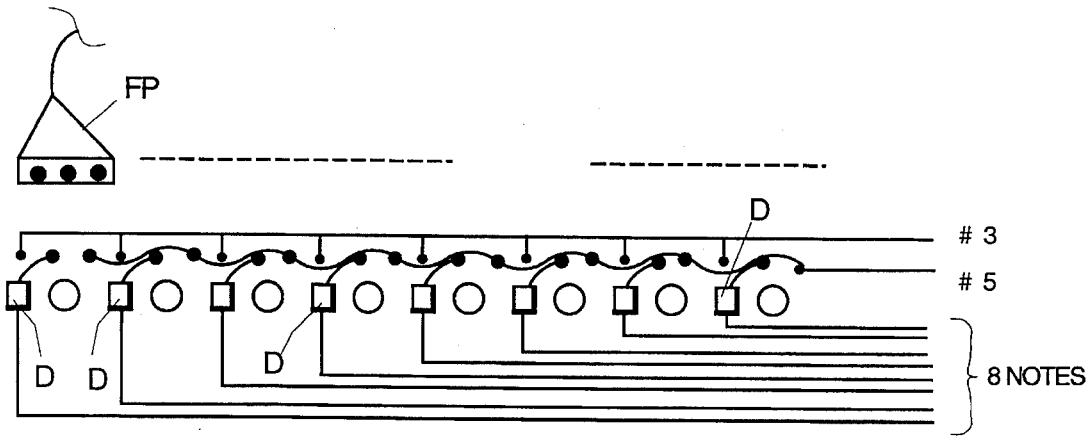
FIG. 2C is a partial view of one key sensor octave circuit incorporated in the invention.
Figure 2D:
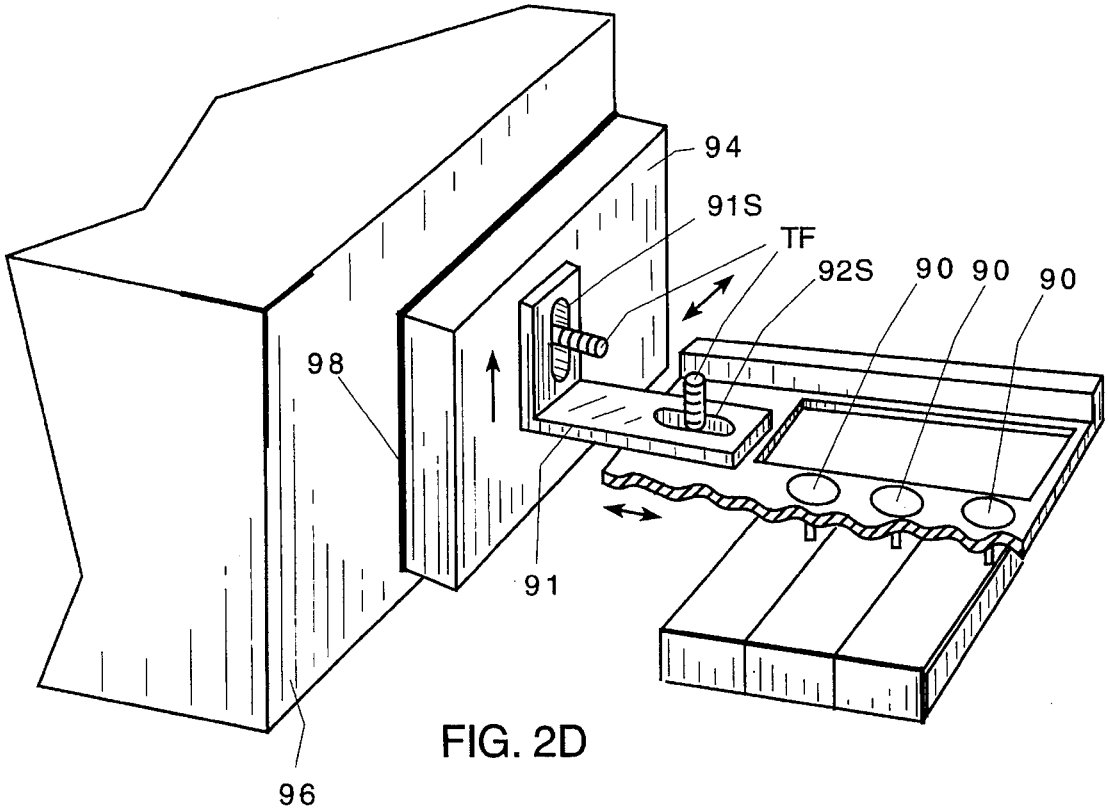
FIG. 2D is an isometric view of the end mounting structure.
Figure 2E:
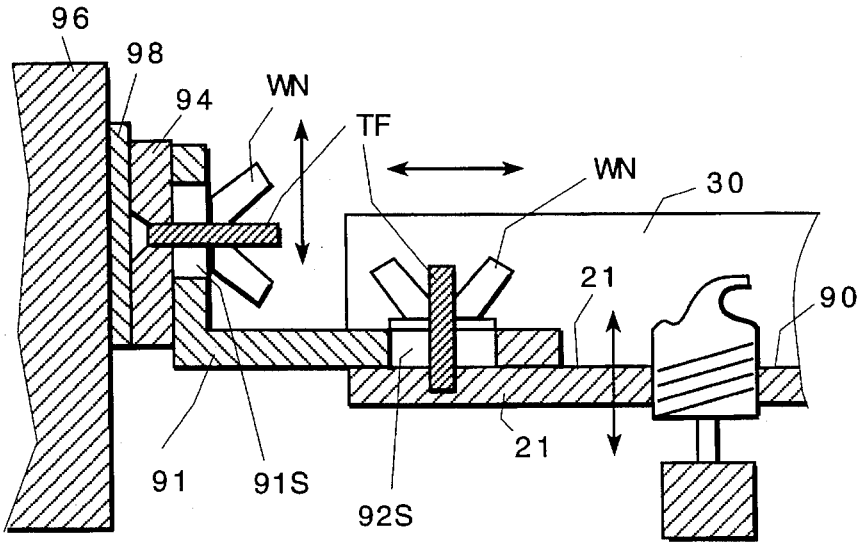
FIG. 2E is a sectional view of the end mounting structure.
Figure 2F:
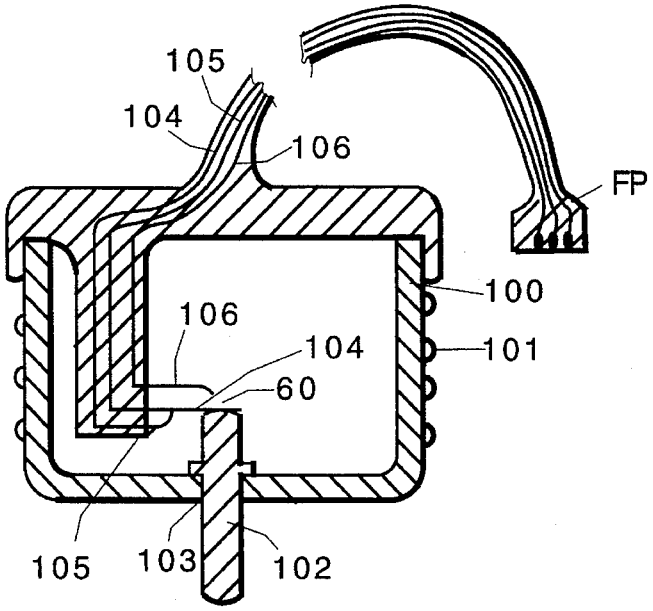
FIG. 2F is a sectional view of the sensor shown in FIG. 2B.

The key actuation sensor strip comprises a rigid bar carrier member 30 which may be a channel or U-shaped metal (preferably light weight aluminum) or, as shown in FIG. 2B, a composite (having flat vertical rigidifying or anti-sag plates 30RP forming or adhered to the legs of the "U") carrier. The base of the "U" is provided with a plurality of threaded bores 90 which are spaced so that each break-gap-make switch would be aligned or congruent with the respective note keys of a piano or organ.

In invention, the sensor carrier or mounting bar 30 is adapted to be mounted above the key levers and inwardly of the common pivot line CPL (FIGS. 4A, 4B) for all of the keys. This location greatly simplifies and expedites the installation, especially in old pianos. In most cases, installation can be accomplished without structural modification of the piano or organ. The lateral ends of the carriers have slotted adjustment and mounting angles 91, 92 on both ends, and a pair of mounting brackets 94 which are secured to the vertical sidewalls of the piano frame 96, 97, preferably by double-sided adhesive tape 98. Angle members 91, 92 have slots 91S, 92S through which threaded fastener TF press. Wing nuts WN are used to secure and tighten the assembly. This allows for easy common vertical adjustment of all sensors and also lateral adjustment to congruence of each sensor with their respective key note levers.

Each key note lever sensor has a housing 100 with a threaded exterior 101 for threaded engagement with the threaded bores 90 to permit individual vertical vernier adjustment to position each sensor a precise distance from each key lever and accommodate slight irregularities in the heights of the piano keys that may have developed through aging and use of the piano or organ being rejuvenated. While the threaded adjustment gives a precise vernier type adjustment and securely holds each key sensor in a fixed position, discrete or stepwise adjustments are within the scope of this invention. This easy adjustment and alignment is an important feature in the rejuvenation of old acoustic pianos and organs.

Each sensor in a preferred embodiment is constituted by a break-gap-make switch with the electronic gap time measurement between break and make constituting a measure of the velocity or intensity with which the musician struck the key (sometimes called "expression"). Break-gap-make switches, per se, are known for this purpose in the music keyboard art. It is obvious that make-gap-break-type sensors may also be used.

In the present invention, each sensor switch assembly includes a central sensor finger or projection 102 which is engaged by the key lever to operate the break-gap-make electrical switch. Each break-gap-make switch has a light-weight plunger 103 carrying a engage spring contact segment 104 that moves in gap GD between two conductive brushes 105 and 106, which are preferably mounted in switch housing 100. For the break-gap-break embodiment brush 105 is contacted by conductive segment 104 in an at rest or quiescent state. Brush 106 is spaced a fixed distance from brush 105 so that the conductive segment 104 must break contact with brush 105 before making electrical contact with brush 106 and the time interval between these two events is measured by the electronic circuitry in the conventional way. The brushes 105 and 106 and the conductive segment 104 are connected to wires and an electrical female plug FP. As diagrammatically illustrated, the center connector is coupled to the conductive segment 104, which electrically connects to center male prong P1 and diode D. The outer connector on plug P are connected to the brushes 105 and 106.

The outer plug connectors couple to the outer male prongs P2 and P3, the P2 prong being connected together and, the P3 prongs being connected together so that any of the prongs can be scanned in conventional fashion.

Thus, as each key is struck by the musician in conventional fashion, the key actuation sensors detect the key switch which has been activated by the musician, the intensity with which it has been struck and the time duration it has been held down, and this data is digitized by conventional A/D converters in MIDI interface controller 11.

Figure 4A:
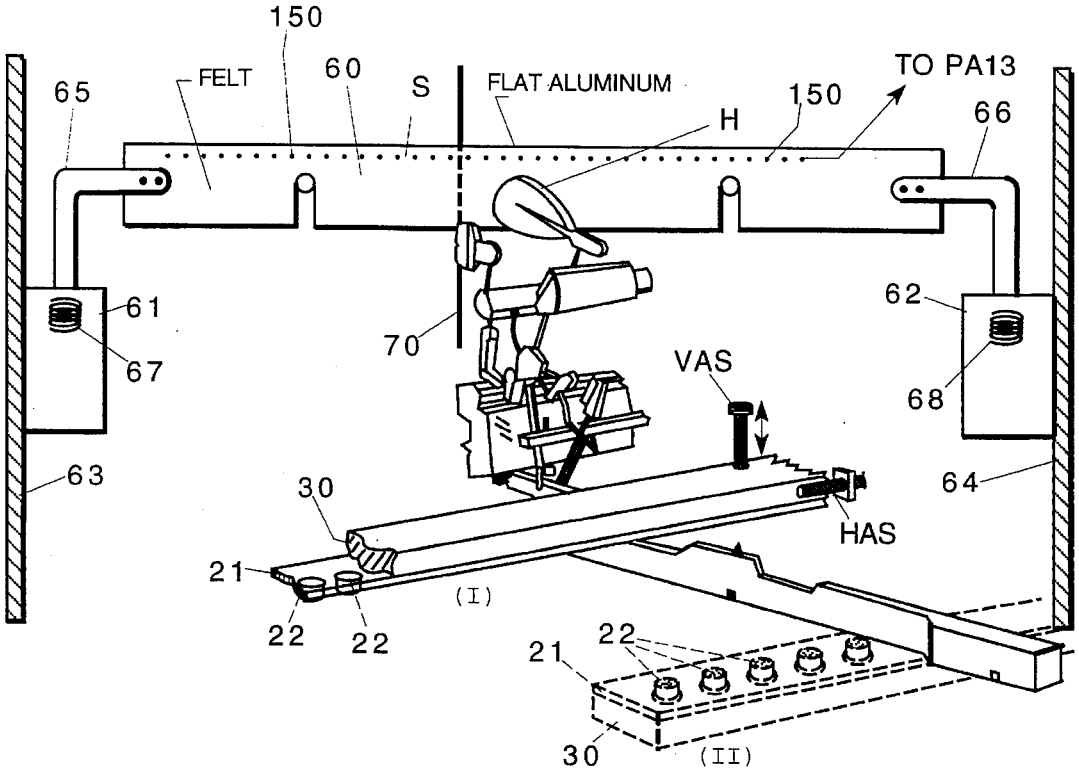
FIG. 4A is an end isometric view of acoustic piano key showing key actuation sensing mechanism and key actuation sensor in its preferred over key position and the piano silencing mechanism in operative position.

Referring to FIG. 4A, installation of the key contact printed circuit board and rigidifying bar is illustrated as being installed in a piano where the contact board is upside down relative to the piano keys and along the top thereof beyond the key pivot. In the preferred upside down position, less disassembly of the piano or organ is required. It will be appreciated that in a number of piano operating mechanisms (see the example of FIGS. 4A and 4B), the key actuation sensor strips can be located in positions to sense movement of a component other than a key.

Figure 4B:
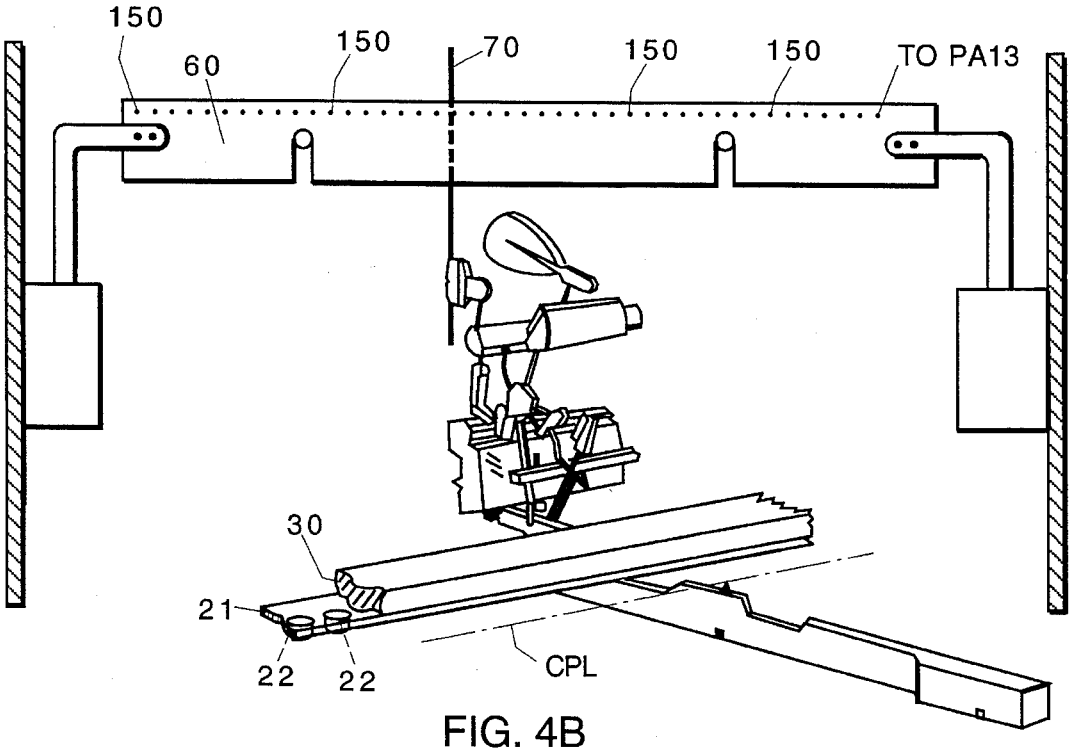
FIG. 4B is an end isometric view similar to FIG. 4A showing the silencing mechanism in inoperative position so the piano can be played in normal fashion (in this case the sensoring is, in effect, optionally disabled), and the magnetic or piezoelectric string vibration sensor strips.
Figure 8:
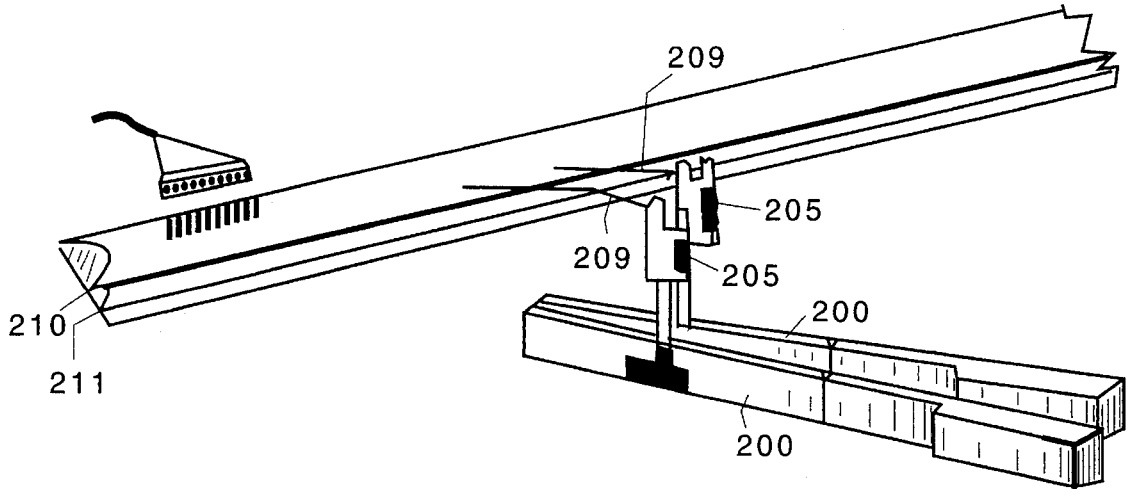
FIG. 8 is an isometric view showing the coupling and positioning of the break-gap-make switch assembly from above the organ keys.
Figure 9A:
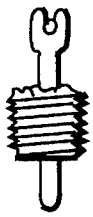
FIGS. 9A, 9B, 9C and 9D show the vertical adjustment assembly and the coupling members.
Figure 9B:
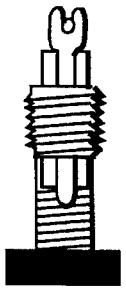
Figure 9C:
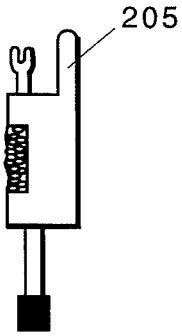
Figure 9D:
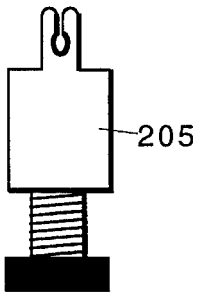
Figure 10:
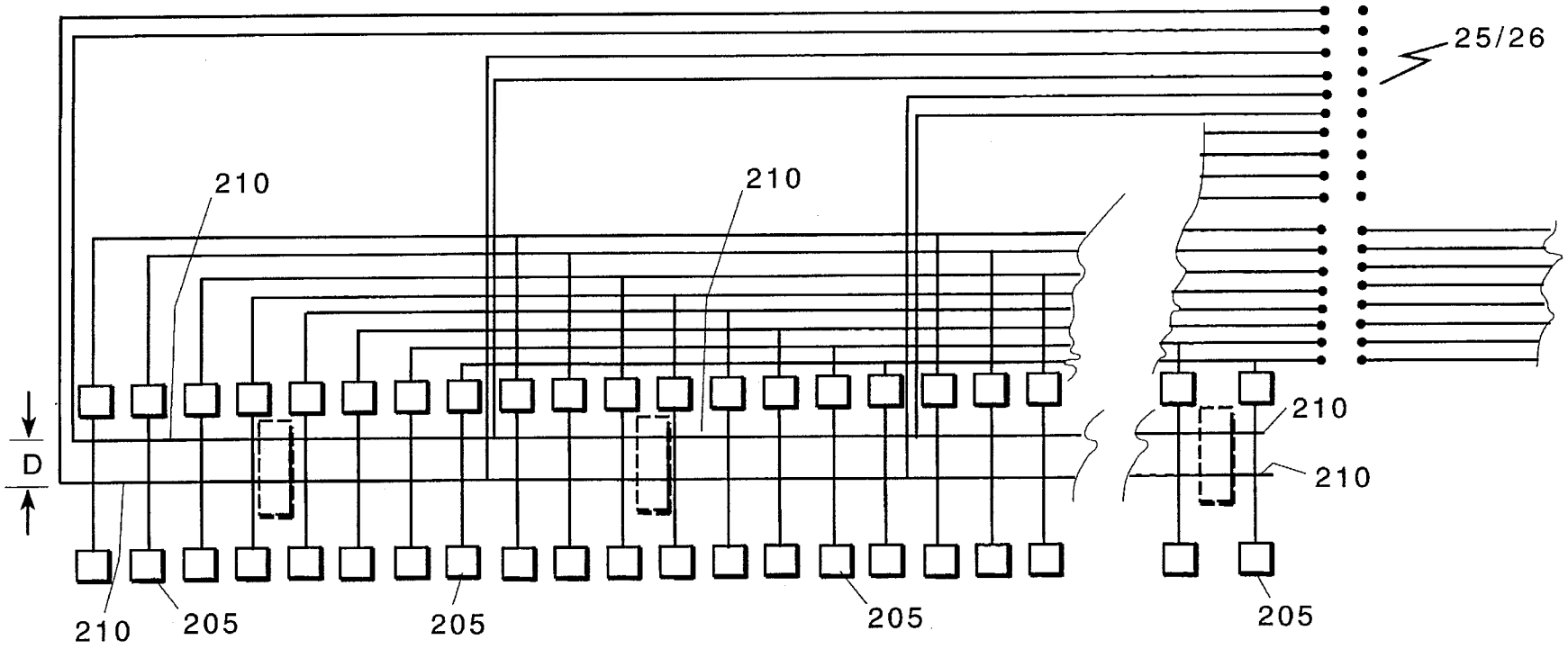
FIG. 10 is a schematic-diagrammatic illustration of the break-gap-make assembly.
Figure 12B:
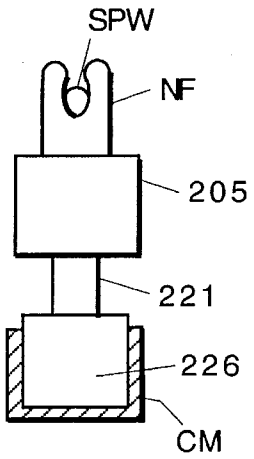
FIG. 12 is a view in the direction of arrows 12A of FIG. 11 and, FIG. 12B is a view in the direction of arrows 12B of FIG. 11.
Figure 12A:
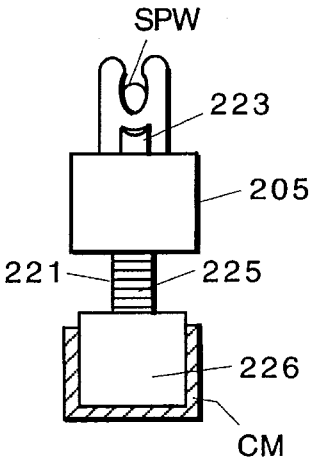
Figure 11:
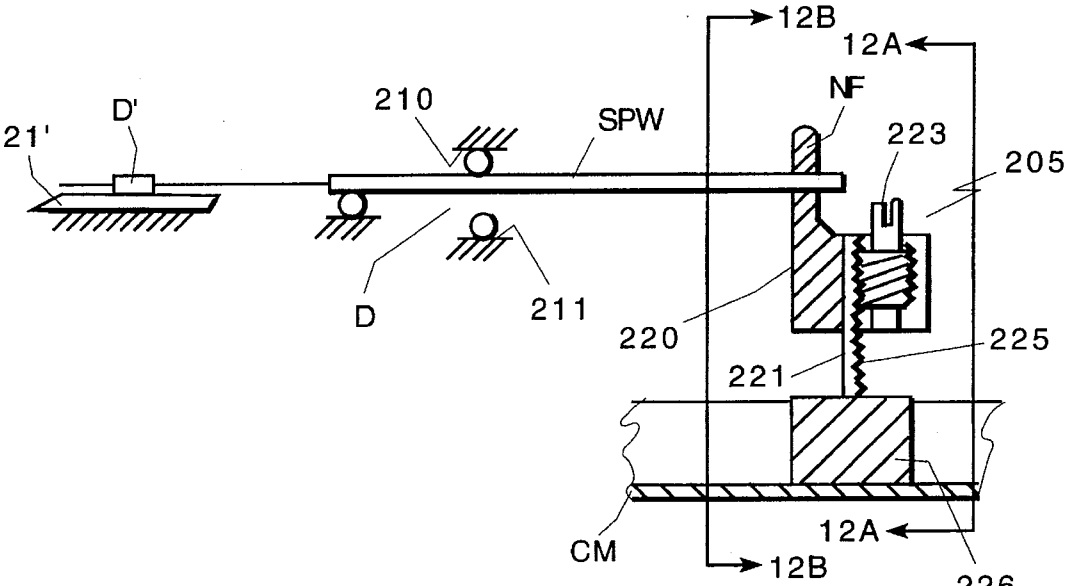
FIG. 11 is a sectional view through a key note channel, vertical adjust coupling assembly and the break-gap-make assembly.

In connection with application of the invention to a piano, it will be noted that in FIGS. 4A and 4B, a felt covered aluminum muting or silencing bar 60 is controlled by one or more solenoids 61, 62, which may be mounted on the piano left and right sidewalls 63, 64, respectively, and have operating arms 65, 66, respectively, which are secured to muting bar 60. Muting bar 60 is preferably comprised of a light-weight aluminum bar which is coated with a felt, foam or other sound absorbing medium. The muting bar 60 could be made of wood, plastic, fiberglass or other rigid materials capable of silently absorbing the impact of the felted note hammer.

Solenoids 61 and 62 are energized by the disable signal 11DA when the power is supplied to the MIDI interface controller 11, for example. Alternatively, a separate independent control switch 68 may be used to couple the solenoids 61 and 62 to a source of operating power. Operating arms 65 and 66 are spring loaded in this embodiment so that on energization of the solenoid 61 and 62, the springs 67, 68 are compressed and loaded so that upon deenergization of the solenoids 61 and 62, the springs 68, 69 urge the arm 65, 66 upwardly so as to reposition the muting or silencing bar 60 in an inoperative position so that the acoustic piano can be played in the normal manner by a musician.

The purpose of the muting or silencing bar 60 is to assure that when the piano keys are played, the hammer and its conventional operating mechanism are not mechanically affected or disabled but that no notes are played or sound made. As shown, in FIG. 4A, when felted hammer H is actuated, it may strike the flat muting or silencing bar 60 but no sound is made by the associated piano string 70 because of the interposition between the hammer H and string 70 of the muting or silencing bar 60. On the other hand, the associated key sensor 21-N is actuated and an electrical signal is generated corresponding to the key actuated, the intensity and duration or expression effects on the keyboard and this signal is then supplied via the cabling (FIG. 2A) to the MIDI interface controller circuit 11 which, in turn, controls the sound module 12 to cause a particular note or sound selected by the musician to be played. Thus, although the keyboard has the same mechanical "feel" as before, no notes are played by the acoustic piano itself. Instead, the musician is in effect using the keyboard in a MIDI system constituted by the system of this invention, with sound source, amplifier(s), and speaker system all built-in.

In FIG. 4B, the silencing or muting bar 60 is shown in an elevated position so that the fitted hammer H and hammer actuating mechanism HAM when actuated by the musician striking the piano key will strike the string 70 to allow the piano to operate in a normal acoustic piano fashion. The springs 67, 68 have, in this condition, elevated the arms 65, 66 which, in turn, elevate the silencing or muting bar 60.

In a further embodiment, an array of magnetic or piezoelectric vibration sensors 150 are carried on the muting bar 60, each sensor S being aligned with a piano string 70 so that it can sense the vibrations either magnetically or piezoelectrically by the pressure waves. The vibration sensors S are strobed in groups and the signals coupled to the power amplifier 13 stored for later use and or accompaniment.

The same key sensing arrangement can be applied to organs and the like keyboard instruments and the same sensor arrangements associated with the keys and keyboards can be applied to the pedals of the piano so as to detect operation of the sustain, sustenuto or soft pedals of the piano by a corresponding pedal contact board.

Similar key contact boards can be mounted under foot pedals 75 to sense actuation of the foot pedals by the musician.

Scanned or strobed outputs from the key contact board 21 are supplied via cable 27 (FIG. 2A) to the MIDI controller module 80 which is conventional (See AKAI MX73 MIDI Master Keyboard) and includes a liquid crystal display 81, master volume control 82 and level controls 83, control or selector switches 84 program select buttons. MIDI controller 80 is positioned on the organ with display 81 in easy view of the musician. The music stand 92 is available for use in conventional fashion. Sound module 95 (element 12 in FIG. 1) is carried on a mounting rack or frame 90 along with other components such as samplers, sequencers, sound modules, etc.

The sound module unit 95 can be of a wide variety, but to enable the vintage organ VEA to sound like an expensive concert grand piano when the lower keys 15L are played, the sound module 95 can be, as noted earlier, Proformance™ Model 9101 or 9102 from E-Mu Systems, Inc.

Figure 7:
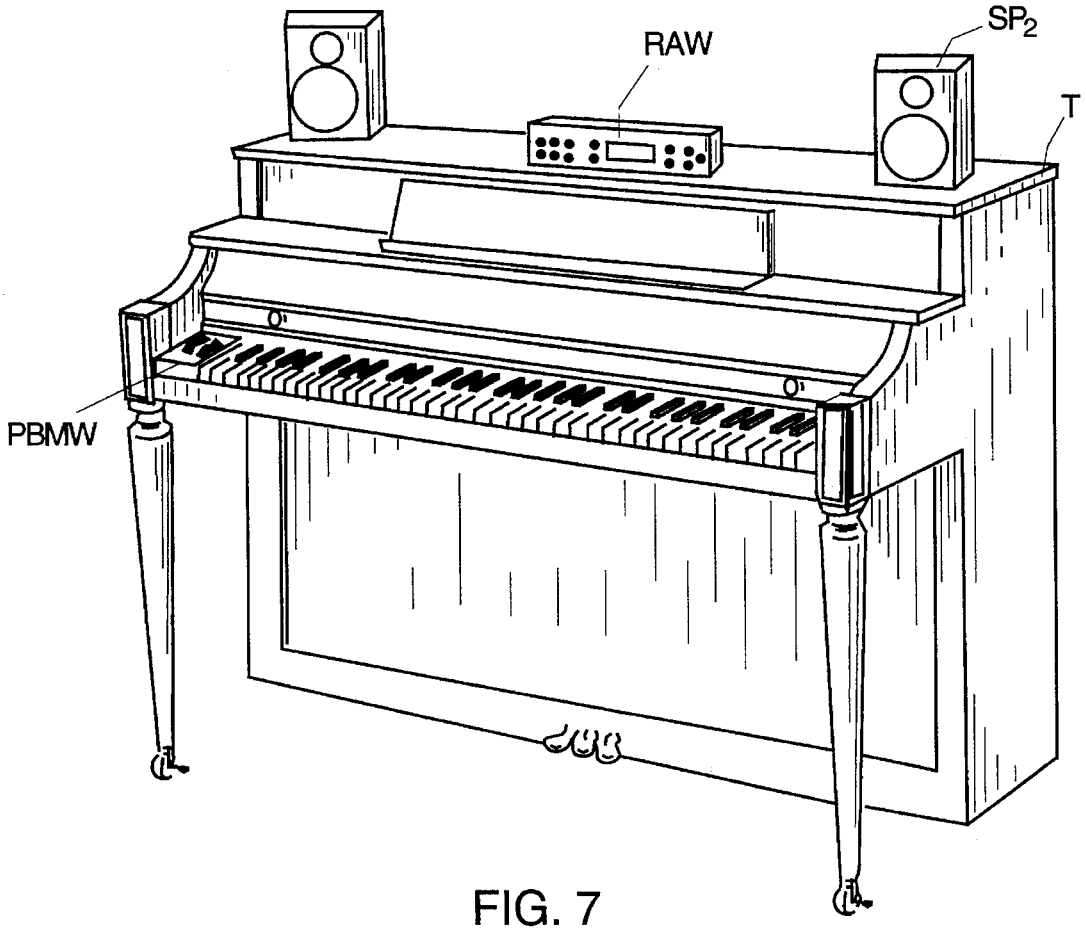
FIG. 7 is an isometric view of an piano incorporating the invention.
Figure 3:
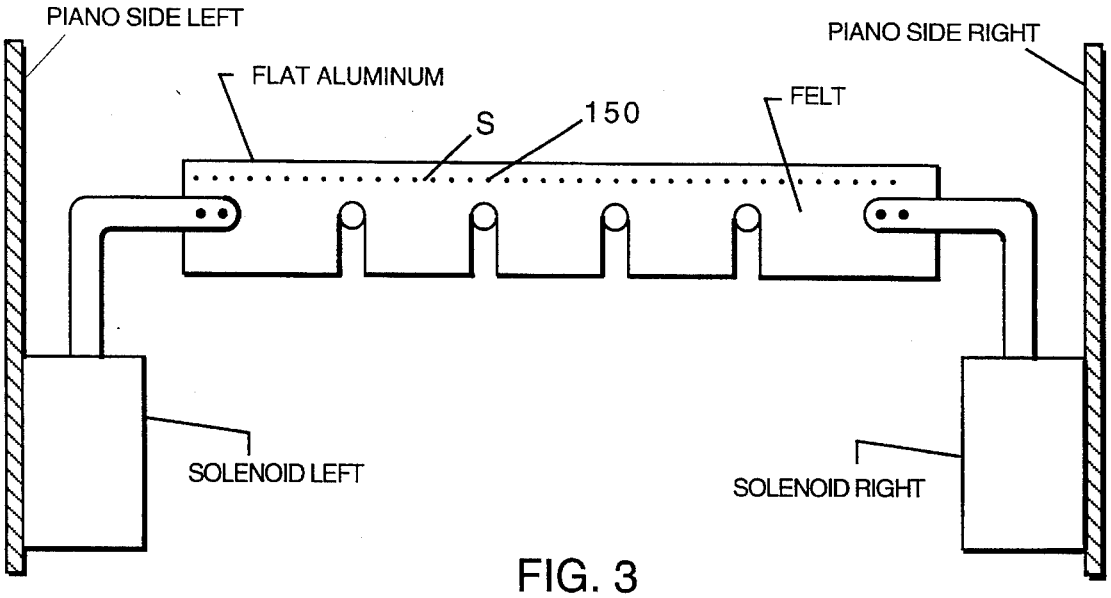
FIG. 3 is an end view of the MIDI system piano silencer according to the invention.

FIG. 7 is an illustration of a piano incorporating the invention. In this illustration, a pair of speakers SP1 and SP2 are mounted at spaced positions on top T of the piano and the electronic MIDI system RAW of this invention is positioned in the center of the top with a cable (not shown in FIG. 7) extending to the break-gap-make key sensor assemblies described earlier. The pitch bend and modulation wheels PBMW are shown to the left of the piano note keys.

In most organs, unlike acoustic pianos, the preferred above key mounting spaced is at a position and are constructed such that the note key channel 200 moves away from the break-gap-make switch assembly mounting bar. In these situations, coupling is made to the key in the manner illustrated in FIGS. 8–12B. As before, the movable switch component 205 are connected through an conventional isolation diode D' to male prongs on an output socket 25, 26. As is conventional, every light movable switch component 209 operates with a single pair of spaced contact wires 210, 211.

In this case, the sensor assembly includes a conventional array of spaced wire contacts 210, 211, there being two spaced wire contacts for each light keys with the pair of spaced wire contacts being spaced a predetermined distance D apart to define the "gap" in the "break-gap-make" switch arrangement described earlier. In this case, a conventional spring finger projects through the space between the wire contacts and is engaged with the upper wire contact. In this aspect of the invention, an adjustable coupling is made from the end of the respective spring contact fingers to the respective keys of the organ from above the keys. In a Hammond (and many other) organ, the keys are comprised of a channel member CM which has a spring mounting tab (not shown), to mount the key on the organ bed and the typical white and black element of the keys are secured to the outer exposed ends of the channel member.

Each key channel CM is frictionally coupled to an adjustable coupler 205, and switch spring wire SPW which are connected to their respective diodes D' and thence to the plugs 25, 26 to external circuitry. The fixed contact wires 210, 211 are coupled to external circuitry in a similar fashion.

As shown in FIGS. 9A–9B and FIGS. 11, 12A and 12B, each individual coupler 205 includes an adjustment to enable old and out-of-alignment or uneven keys to be "aligned" with the system so that the striking of the organ keys will all be sensed in precisely the same manner. A plastic body member 220 has an upwardly projecting notch finger NF which frictionally engages switch spring wire SPW. A movable rack member 221 is slidable in body member 220 in up and down fashion and is translated in those directions by threaded engagement with adjusting screw 222 which has a slotted lead 223 and threads 224 engaged with threads 225 on movable rack member 221.

The foot of rack member 221 carries a friction pad 226 which is compressed and for all loads or forces couples the key channel CM to rack member 221. Thus, downward movement of the key channel CM actuates the respective spring switch wire member SPW to cause the break-gap-make action described earlier herein.

Thus, by means of these expedients, old or vintage pianos and organs can be rejuvenated at relatively low cost so that they are in effect upgraded to the level of modern electronic musical instruments and at relatively low cost. This provides these vintage and timeworn keyboard musical instruments with the great flexibility and ease of using modern electrical and electronic components at significantly lower cost and eliminates the requirement or need to replace these old pianos and organs thereby extending their useful life indefinitely.

While there has been shown and described preferred embodiments of the invention, it will be appreciated that various embodiments, adaptations and modifications of the invention will be readily apparent to those skilled in the art and can be made without departing from the spirit of the invention or the scope of the appended claims.

What is claimed is:

1. A system for rejuvenating conventional old keyboard musical instruments to MIDI standards, comprising:

one or more linear arrays of key actuation sensors, printed circuit board means carrying said key actuation sensors for sensing key actuation and expression effects by a musician, means for mounting said one or more linear arrays above the keyboard of said musical instrument to convert each key actuation and expression effect of the musician to first coded electrical signals, respectively, each said key actuation sensor including means for individually vertically adjusting said sensor relative to said means for mounting, control means connected to receive said first coded digital electrical signals and provide digital note control signals in MIDI format, means for simultaneously silencing all key notes of said conventional keyboard musical instrument, and one or more performance modules connected to receive said digital note control signals and produce a musical performance.

2. The invention defined in claim 1 wherein said means for mounting includes a rigid bar or channel member, a plurality of threaded bores adapted to be spaced over respective ones of said keys, each said key actuation sensor having a housing with a threaded exterior threadably engaged with a respective one of said threaded bores.

3. The invention defined in claim 1, said printed circuit-board means including a rigidifying means and wherein said rigidifying means is mounted above the keys on said keyboard and includes means at the lateral ends providing for horizontal and vertical adjustments of said rigidifying means.

4. The invention defined in claim 1 wherein said conventional keyboard instrument has foot pedals operated by said musician to enhance and/or modify a musical rendition, transducer means for converting actuation of foot pedals by a musician to foot pedal control signals and means connecting said foot pedal control signals to said control means.

5. The invention defined in claim 4 wherein said old keyboard instrument is an acoustic piano having an array of piano strings which are adapted to be struck by an array of felted hammers, and said means for selectively silencing includes a rigid bar and sound absorbing means on said bar, said bar being positionable between said arrays of hammers on piano strings, and a plurality of magnetic sensors, mounted on said bar to sense vibration of said strings when said means for selectively silencing is in an inoperative position for silencing.

6. The invention defined in claim 5 including solenoid means for positioning said rigid bar between said array of hammer and said piano strings.

7. The invention defined in claim 6 including means for producing a disable signal, and means controlled by said disable signal for positioning said rigid bar between said arrays of hammer and piano strings.

8. The invention defined in claim 2 wherein said musical instrument is a vintage electronic organ having an operating circuit, and including means for disabling said operating circuit in said vintage electronic organ.

9. The invention defined in claim 8 wherein said key actuation sensor incudes means for coupling each respective key actuation sensor to its associated key of said keyboard.

10. The invention defined in claim 9 wherein said means for coupling includes, for each key, a friction retention member for coupling said key actuation sensor to each key, respectively.

11. The invention defined in claim 9 wherein each said key includes a U-shaped channel member, and said means for coupling includes a compressible retention member frictionally retained between the legs of said U-shaped channel.

12. The musical keyboard sensor defined in claim 10 wherein each said key sensor switch means is a break-gap-make switch, and includes:

a key engaging stem, spring bias member moveable by said stem, a pair of fixed brush elements and a moveable conductor segment on said spring bias member which is moveable from contact with one of said brush elements to where it contacts the other of said brush elements.

13. The invention defined in any one of claims 1, 8, 9, 10 or 11, wherein said key actuation sensors include an insulated frame and sets of vertically spaced parallel contact wires mounted in said insulated frame, a cantilever spring contact finger, one for each key, projecting through the space between said vertically spaced control wires and contacting an upper one of said contact wires and movable in a downward direction to engage the lower of said contact wires to thereby provide a break-gap-make sensor switch for each key actuation sensor, and means connecting said control wires and cantilever spring contact fingers to said control means.

14. A method of rejuvenating vintage keyboard musical instruments to MIDI standards, comprising:

installing one or more linear arrays of key actuation sensors above the keys on the keyboard of said musical instrument to convert each key actuation and expression effects of the musician to first coded electrical signals, respectively, vertically adjusting individual ones of said key actuation sensors to accommodate any of said keys which are uneven relative to a horizontal plane due to aging or wear, silencing all keys said vintage keyboard musical instrument simultaneously, converting said first coded digital electrical signals to digital note control signals in MIDI format, and operating one or more performance modules connected to receive said digital note control signals and produce a musical performance.

15. The invention defined in claim 14 including means for storing said electrical signals.

16. The invention defined in claim 15 including a loud speaker system for converting said electrical signals to sound.

17. In a musical keyboard key switch sensor, wherein there are a plurality of aligned keys, each of which includes a key lever pivotally mounted and, when struck, operate a note actuator mechanism and include a key switch sensor means, one for each key, respectively, and an electrical coupling circuit for coupling said key switch to a musical function circuit, the improvement wherein said key sensor switch includes a rigid mounting bar member, means for adjustably positioning said rigid mounting bar above each said key levers, a plurality of threaded bore holes in said rigid bar member, and a key sensor switch housing threadably engaged in each of said threaded holes, respectively, and a key sensor switch mean sin each housing, the threaded engagement of said housing with said rigid bar member providing vertical adjustment for each key sensor switch to accommodate uneven wear in said keys.

18. In a keyboard musical instrument having keys, which when activated cause a note operating mechanism to strike and vibrate a metal string to produce musical notes, the improvement comprising:

a silencer bar positioned to be interposed between said string and note operating mechanism from a neutral position, and means for operating said silencer bar, microphone means mounted on said silencer bar and positioned adjacent said strings to pick-up vibrations therein when said silencer bar is in said neutral position, and producing electrical signals corresponding thereto, and electronic amplifier means for receiving and amplifying said electrical signals.

19. A method for installing key actuation and expression effect sensors on a keyboard instrument, comprising:

installing a linear array of key actuation sensors carried on a rigidified circuitboard above the keys of said keyboard, and vertically adjusting individual ones of said key actuation sensors in a vertical direction to accommodate any of said keys which are uneven relative to a horizontal plane due to aging or wear.

* * * * *